US005766834A

United States Patent [19]

Chen et al.

[11] Patent Number: 5,766,834

[45] Date of Patent: Jun. 16, 1998

[54] PHOTOGRAPHIC ELEMENT CONTAINING ULTRAVIOLET ABSORBING POLYMER

[75] Inventors: Tienteh T Chen, Penfield; Lal C Vishwakarma; Hwei-Ling Yau, both of Rochester, all of N.Y.

[73] Assignee: Eastman Kodak Company, Rochester, N.Y.

[21] Appl. No.: 712,228

[22] Filed: Sep. 11, 1996

Related U.S. Application Data

[63] Continuation-in-part of Ser. No. 650,069, May 17, 1996, abandoned.

[60] Provisional application No. 60/003,087, Aug. 31, 1995.

[51] Int. Cl. [6] ..... G03C 1/815

[52] U.S. Cl. ..... 430/512; 430/514; 430/516; 430/517; 430/523

[58] Field of Search ..... 430/512, 523, 430/516, 514, 517

[56] References Cited

U.S. PATENT DOCUMENTS

| | | | |
|---|---|---|---|
| 3,215,530 | 11/1965 | Riebel et al. | 96/48 |
| 3,253,921 | 5/1966 | Sawdey | 96/73 |
| 3,278,448 | 10/1966 | Lauerer et al. | 252/300 |
| 3,352,681 | 11/1967 | Ohi et al. | 96/84 |
| 3,705,805 | 12/1972 | Nittel et al. | 96/84 |
| 3,707,375 | 12/1972 | Ohi et al. | 96/84 |
| 3,738,837 | 6/1973 | Kuwabara et al. | 96/84 |
| 3,745,010 | 7/1973 | Janssens et al. | 96/84 |
| 3,761,272 | 9/1973 | Mannens et al. | 96/84 |
| 3,813,255 | 5/1974 | Mannens et al. | 117/33.3 |
| 4,045,229 | 8/1977 | Weber, II et al. | 96/84 |
| 4,307,184 | 12/1981 | Beretta et al. | 430/512 |
| 4,340,664 | 7/1982 | Monbaliu et al. | 430/449 |
| 4,431,726 | 2/1984 | Kojima et al. | 430/512 |
| 4,455,368 | 6/1984 | Kojima et al. | 430/507 |
| 4,464,462 | 8/1984 | Sugimoto et al. | 430/512 |
| 4,464,735 | 8/1984 | Toyoda et al. | 365/190 |
| 4,496,650 | 1/1985 | Yagihara et al. | 430/381 |
| 4,513,080 | 4/1985 | Helling | 430/537 |
| 4,663,272 | 5/1987 | Nakamura | 430/542 |
| 4,752,298 | 6/1988 | Burglia et al. | 8/527 |
| 4,790,959 | 12/1988 | Sasaki et al. | 252/589 |
| 4,853,471 | 8/1989 | Rody et al. | 548/261 |
| 4,865,957 | 9/1989 | Sakai et al. | 430/505 |
| 4,943,519 | 7/1990 | Helling et al. | 430/512 |
| 5,384,235 | 1/1995 | Chen et al. | 430/512 |
| 5,500,332 | 3/1996 | Vishwakarma et al. | 430/512 |

FOREIGN PATENT DOCUMENTS

| | | | |
|---|---|---|---|
| 0 190 003 | 9/1991 | European Pat. Off. | G03C 1/815 |
| 63-55542 | 6/1979 | Japan . | |
| 1338265 | 11/1973 | United Kingdom | G03C 7/00 |
| 1346764 | 2/1974 | United Kingdom | G03C 1/00 |
| 1504949 | 3/1978 | United Kingdom | C08J 3/20 |
| 1504950 | 3/1978 | United Kingdom | C08J 3/20 |

OTHER PUBLICATIONS

Research Disclosure No. 30370, Jul. 1989, Kenneth Mason Publications, Ltd., Dudley House, 12 North Street, Emsworth, Hampshire P010 7DQ, England.

Research Disclosure No. 18815, Dec. 1979, Kenneth Mason Publications, Ltd., Dudley House, 12 North Street, Emsworth, Hampshire P010 7DQ, England.

Research Disclosure No. 32592, May 1991, Kenneth Mason Publications, Ltd., Dudley House, 12 North Street, Emsworth, Hampshire P010 7DQ, England.

*Primary Examiner*—Thorl Chea

*Attorney, Agent, or Firm*—Edith A. Rice

[57] ABSTRACT

This invention relates to a photographic element containing a polymeric ultraviolet absorbing polymer fromed from an ultraviolet absorbing monomer of formula (I):

(I)

where X is a bivalent linking group, and Y contains an ethylenically unsaturated functional group.

13 Claims, 2 Drawing Sheets

PHOTOGRAPHIC ELEMENT CONTAINING ULTRAVIOLET ABSORBING POLYMER

CROSS-REFERENCE TO RELATED APPLICATIONS

This is a continuation-in-part of application Ser. No. 08/650,069, filed May 17, 1996, now abandoned, entitled "Photographic Element Containing Ultraviolet Absorbing Polymer" by Tienteh Chen et al., which in turn claims priority from provisional application 60/003,087 filed Aug. 31, 1995, the entire disclosures of which are incorporated herein by reference.

FIELD OF THE INVENTION

This invention relates to a benzotriazole based UV absorbing monomer, to a polymer formed from said monomer and to a photographic element containing said polymer.

BACKGROUND OF THE INVENTION

Typical photographic elements comprise a support bearing at least one light sensitive layer. The light sensitive layer generally comprises a silver halide emulsion, the silver halide having a native sensitivity to ultraviolet radiation ("UV"). UV is usually regarded as radiation having a wavelength of less than about 400 nanometers (nm). UV sensitivity of silver halide is usually undesirable in that it produces an image on the photographic element which is not visible to the human eye. In addition, in the case of color photographic elements, and particularly, dye images formed in the light-sensitive emulsion layers by color development easily undergo fading or discoloration due to the action of UV. Also, color formers, or so-called couplers, remaining in the emulsion layers are subject to the action of UV which can result in undesirable color stains on the finished photograph. The fading and the discoloration of the color images are easily caused by UV of wavelengths near the visible region, namely, 300 to 400 nm. For the foregoing reasons, photographic elements typically incorporate a UV absorbing material in an upper layer of the element.

Many types of UV absorbing materials have been described previously, and include those described in U.S. Pat. Nos. 3,215,530, 3,707,375, 3,705,805, 3,352,681, 3,278,448, 3,253,921, and 3,738,837, 4,045,229, 4,790,959, 4,853,471, 4,865,957, and 4,752,298 and British Patent No. 1,338,265. Known UV absorbing materials have many undesirable characteristics. For example, they tend to color and form stains due to their insufficient stability to UV, heat, and humidity. Also, a high-boiling organic solvent is usually required for the emulsification of the UV absorbing material, which softens the layer and substantially deteriorates interlayer adhesion. In order to prevent such problems, a large amount of gelatin has been used in the layer containing the UV absorbing material, resulting in a layer that may be unstable. Alternatively, a separate gelatin protective layer can be provided. This results in undesirable thickening of the element. Furthermore, the previously known UV absorbing materials, when provided in the uppermost layer of a photographic element, often migrate and crystallize at the surface of the layer and thus a gel overcoat is provided to minimize this undesirable blooming phenomenon. Furthermore, the droplets of such UV absorbing materials prepared by the conventional emulsification method described above usually has particle size greater than 200 nm which tend to cause light scattering with resulting deterioration of the element's photographic properties.

Although some of these problems can be eliminated by using liquid UV absorbing materials as disclosed in Research Disclosure 30370, July 1989, they still need to be emulsified into very fine droplets in a two-phase aqueous/nonaqueous system, and a top overcoat layer is needed above them. Also, the toxicity of certain UV absorbing materials has become an important issue recently.

It is known that polymeric UV absorbing materials obtained by polymerization of UV absorbing monomers can be utilized as UV absorbing materials which do not have many of the disadvantages described above. Three processes for adding polymeric ultraviolet absorbing material in the form of dispersion to hydrophilic colloid composition have been known. The first process comprises adding a latex prepared by emulsion polymerization directly to a gelatin-containing silver halide emulsion. Emulsion polymerization is well known in the art and is described in F. A. Bovey, *Emulsion Polymerization*, issued by Interscience Publishers Inc. New York, 1955. This is the most direct way of preparing polymer latex.

The second way of forming polymer dispersion is by solution polymerization of a monomer mixture comprising UV absorbing monomer and hydrophobic comonomers. An organic solvent is used for dissolving the hydrophobic polymeric ultraviolet absorbing material and the solution is dispersed in an aqueous solution of gelatin in the form of latex.

Polymeric UV absorbing polymer dispersions prepared by these two processes have been described in, for example, U.S. Pat. Nos. 3,761,272, 3,745,010, 4,307,184, 4,455,368, 4,464,462, 4,513,080, 4,340,664, British Patents Nos. 1,504,949, 1,504,950, and 1,346,764, and European Patent Application 0 190 003.

The third way of forming polymer dispersion is by solution polymerization of a monomer mixture comprising UV absorbing monomer, diluent comonomers, and an ionic comonomer containing sulfonate, sulfate, sulfinate, carboxylate or phosphate functional groups, such as acrylamido-2,2'-dimethyl-propane sulfonic acid, 2-sulfoethyl methacrylate, or sodium styrene sulfonate. The polymer solution obtained is then dispersed in aqueous solution to form a dispersion. A detailed description of this procedure is described in U.S. patent application Ser. No. 08/361,276 filed Dec. 21, 1993.

The use of polymeric ultraviolet absorbing material for photographic applications has been described in the art. Examples include U.S. Pat. Nos. 3,761,272 and U.S. Pat. No. 3,813,255, Research Disclosure 18815, U.S. Pat. No. 4,464,462, U.S. Pat. No. 4,431,726, U.S. Pat. No. 4,464,735, U.S. Pat. No. 4,455,368, U.S. Pat. No. 4,496,650, U.S. Pat. No. 4,663,272, JP 63 55542, U.S. Pat. No. 4,943,519, U.S. Pat. No. 5,384,235, EP 0 190 003 and Research Disclosure 32592. EP 0 190 003 describes the use of polymeric ultraviolet absorbing material containing 2-hydroxy-4-(m, or p)-vinylbenzyloxy-2-benzotriazole in the photographic materials. Research Disclosure 32592 describes the use of polymeric ultraviolet absorbing material ,derived from the 2-hydroxy-methacryloxypropyl ester of 2-hydroxy-3-t-butyl-5-(propionic acid)-benzotriazole, for the protection of photographic products. U.S. Pat. No. 5,384,235 describes the use of polymeric ultraviolet absorbing material, derived from the 2-hydroxy-5-acryloxyethyl-2H-benzotriazole, for the protection of photographic products.

These known polymeric UV absorbing materials have one or more of the following problems: (1) the UV absorbing monomer itself is hard to synthesize; (2) the UV absorbing monomer is hard to polymerize by emulsion polymerization; (3) the absorption spectrum of the polymeric UV absorbing material is not desirable; (4) the light stability of the polymeric UV absorbing material is relatively poor; (5) the photographic performance of the polymeric UV absorbing material, such as fresh Dmin, image dye fade, and light-induced yellowing, are not satisfactory. It is thus desirable to have a photographic element which used a polymeric UV absorbing compound which has at least one of the foregoing characteristics improved.

SUMMARY OF THE INVENTION

One aspect of this invention comprises novel ultraviolet absorbing monomers having the structural formula (I):

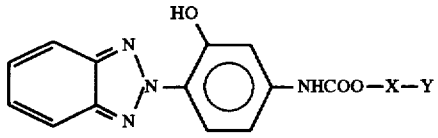

(I)

where X is a bivalent linking group, and Y contains an ethylenically unsaturated functional group.

Another aspect of this invention comprises novel ultraviolet absorbing polymers which include units formed from a monomer having the structural formula (I). The polymer can also include units formed from one or more other ethylenically unsaturated comonomers.

A further aspect of this invention comprises a photographic element containing an ultraviolet absorbing polymer which includes units formed from monomers having the structural formula (I).

ADVANTAGEOUS EFFECT OF THE INVENTION

Photographic elements of this invention have improved photographic performance, in particular, fresh Dmin, and resistance to image dye fade and light-induced yellowing.

DETAILED DESCRIPTION OF THE INVENTION

Figure 1:
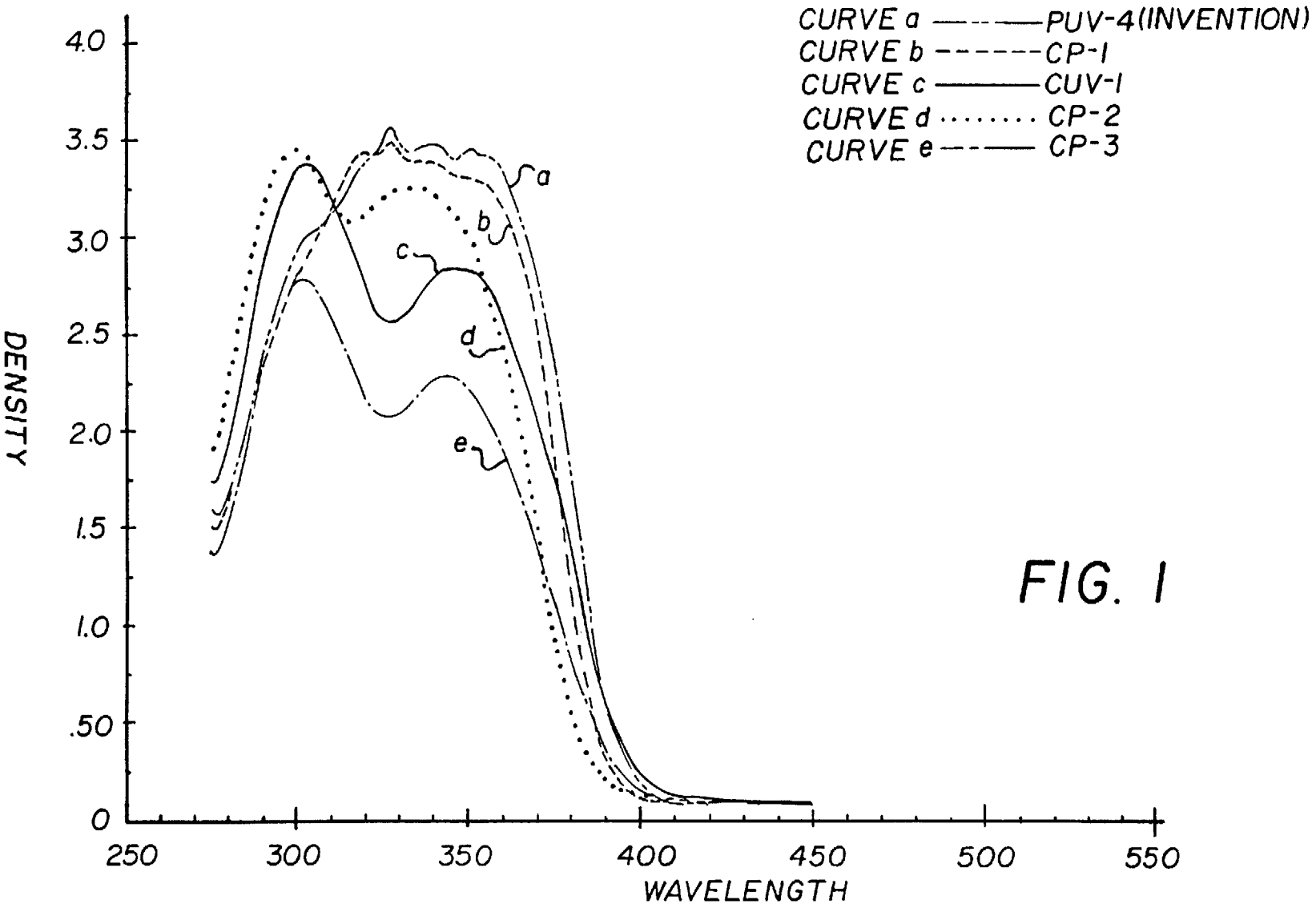
FIGS. 1 and 2 are graphs showing absorption curves of UV absorbing polymer of this invention and comparison UV absorbing materials.

By reference to "under", "above", "below", "upper", "lower" or the like terms in relation to layer structure of a photographic element, is meant in this application, the relative position in relation to light when the element is exposed in a normal manner. "Above" or "upper" would mean closer to the light source when the element is exposed normally, while "below" or "lower" would mean further from the light source. Since a typical photographic element has the various layers coated on a support, "above" or "upper" would mean further from the support, while "below" or "under" would mean closer to the support. It will also be understood that reference to any broader formula includes reference to compounds with a narrower formula within the broader formula (for example, reference to compounds of formula (I) having particular substituents includes the possibility of compounds of formula (II) having the same substituents unless otherwise indicated).

In reference to "polymers" having units formed from monomers of formula (I) (as already discussed, this includes any compounds falling within formula (I), such as compounds of formula (II), this means that the compound would contain at least 10 (and preferably at least 20 and more preferably at least 50) repeating units of the monomer of formula (I). Typically the polymers would have hundreds (for example, three hundred or more) or several thousand (for example, three thousand or more) repeating units.

For a compound to be considered a UV absorbing polymer in the present invention, it should at least absorb somewhere in the 300 to 400 nm region of the spectrum. When reference in this application is made to a substituent "group", this means that the substituent may itself be substituted or unsubstituted (for example "alkyl group" refers to a substituted or unsubstituted alkyl). Generally, unless otherwise specifically stated, substituent groups usable on molecules herein include any groups, whether substituted or unsubstituted, which do not destroy properties necessary for the photographic utility. However, preferably such substituents will not have any unsaturated carbon-carbon bonds since these may cause cross polymerization during polymerization of the corresponding monomer.

Examples of substituents on any of the mentioned groups can include known substituents, such as the following except where otherwise excluded: halogen, for example, chloro, fluoro, bromo, iodo; alkoxy, particularly those "lower alkyl" (that is, with 1 to 6 carbon atoms, for example, methoxy, ethoxy; substituted or unsubstituted alkyl, particularly lower alkyl (for example, methyl, trifluoromethyl); thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1, 2 or 3 heteroatoms selected from N, O, or S (for example, pyridyl, thienyl, furyl, pyrrolyl); and others known in the art. Alkyl substituents may specifically include "lower alkyl" (that is, having 1–6 carbon atoms), for example, methyl, ethyl, and the like. Further, with regard to any alkyl group or alkylene group, it will be understood that these can be branched or unbranched and include ring structures.

It will also be understood throughout this application that reference to a compound of a particular general formula includes those compounds of other more specific formula which specific formula falls within the general formula definition.

The novel UV absorbing monomers of this invention have the structural formula (I):

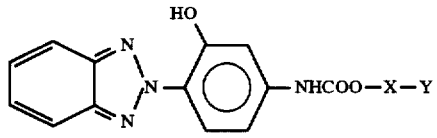

(I)

wherein, X is a bivalent linking group and Y is an ethylenically unsaturated functional group.

Preferably X is:

$$-(((CH_2)_q-W)_r-CH_2)_s-,\ -(((CH_2)_q-W)_r-(CH_2)_{q'})_s-$$

or $$-(CH_2)_t-Z-(CH_2)_u-$$

wherein W is oxygen or sulfur; Z is —NHCO—; —$CO_2$—; —$SO_2$— and q is 1–4, r is 0–4, s is 1–6, t is 1–6, and u is 1–6.

Preferably Y is:
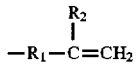
where $R_1$ is:
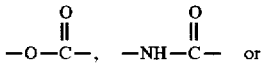
-continued
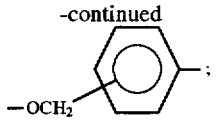
and $R_2$ is H or lower alkyl.
Examples of UV monomers defined by formula I are as follows:
UV-1
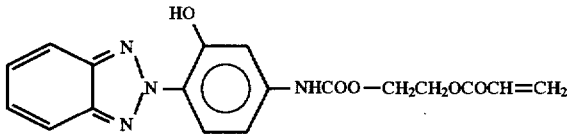
UV-2
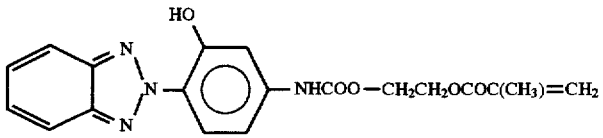
UV-3
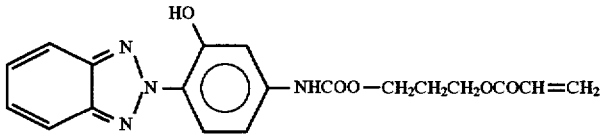
UV-4
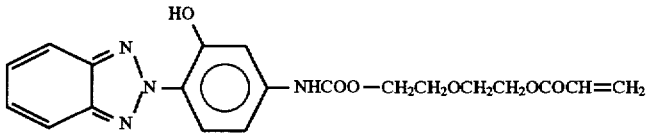
UV-5
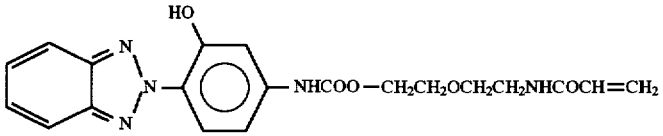
UV-6
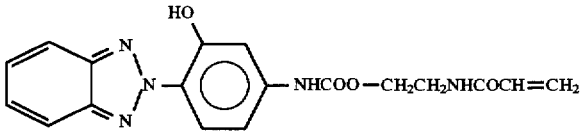
UV-7
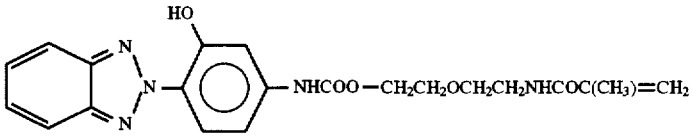
UV-8
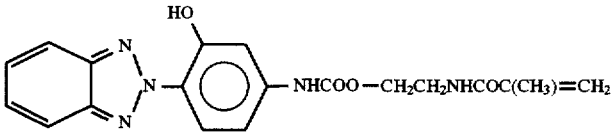
UV-9
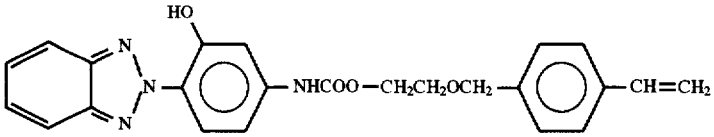

-continued

UV-10

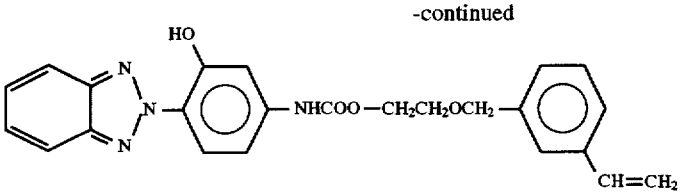

UV-11

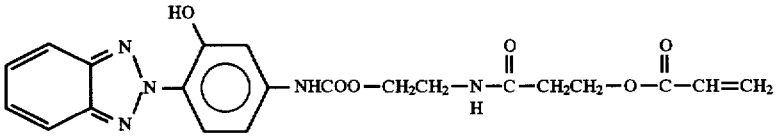

UV-12

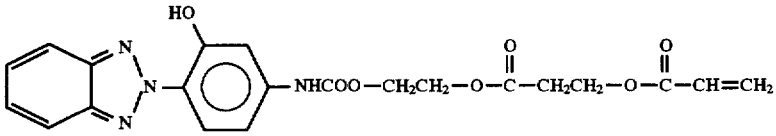

UV13

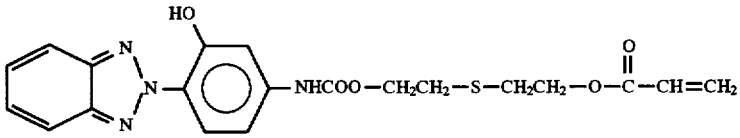

UV14

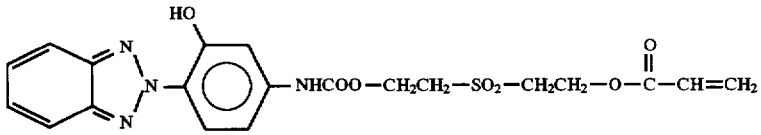

UV15

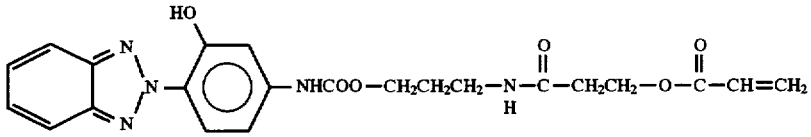

UV16

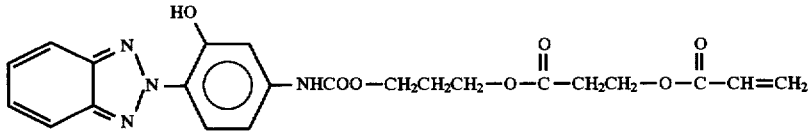

The UV monomers defined in formula I can be homopolymerized or copolymerized with other ethylenically unsaturated comonomers. Examples of ethylenically unsaturated comonomers include an acrylic acid, an α-alkylacryl acid (such as methacrylic acid, etc.), an amide or ester derived from an acrylic acid or methacrylic acid (for example, acrylamide, methacrylamide, n-butylacrylamide, t-butylacrylamide, diacetone acrylamide, methyl acrylate, ethyl acrylate, n-propylacrylate, n-butyl acrylate, t-butyl acrylate, isobutyl acrylate, 2-ethylhexyl acrylate, n-octyl acrylate, lauryl acrylate, 2-ethoxyethyl acrylate, 2-methoxyethyl acrylate, methyl methacrylate, ethyl methacrylate, n-butyl methacrylate, b-hydroxyl methacrylate, etc.), a vinyl ester(for example, vinyl acetate, vinyl propionate, vinyl laurate, etc.), acrylonitrile, methacrylonitrile, an aromatic vinyl compound (for example, styrene or a derivative thereof, for example, vinyl toluene, divinylbenzene, vinyl acetophenone, sulfostyrene, etc.), itaconic acid, citraconic acid, crotonic acid, vInylidene chloride, a vinyl alkyl ether (for example, vinyl ethyl ether, etc.), an ester of maleic acid, N-vinyl-2-pyrrolidone, N-vinylpyridine, 2- or 4-vinylpyridine, etc., a sulfonic acid containing monomer, (for example, acrylamido-2,2'-dimethyl-propane sulfonic acid, 2--sulfoethyl methacrylate, 3-sulfopropyl methacylate, etc.).

Of these monomers, esters of acrylic acid, esters of methacrylic acid, and aromatic vinyl compounds are particularly preferred.

Two or more of the above-described comonomers can be used together, for example, a combination of butyl acrylate and acrylamido-2,2'-dimethyl propane sulfonic acid.

Two or more of the UV absorbing monomers defined in formula (I) can be copolymerized together, for example, a combination of UV-1 and UV-2. The UV absorbing monomers can also be copolymerized with other UV absorbing monomers, such as those described in the prior art.

A high boiling organic solvent (so-called coupler solvent) can also be added or loaded to the polymeric UV absorbing material to modify the physical properties of the photographic materials incorporating the UV absorbing material. The loading of high boiling organic solvents into polymer latex was described in the following: U.S. Pat. Nos. 4,199,363, 4,203,716, 4,214,047, 4,247,627, 4,497,929, 4,608,424, and 5,372,922.

Conventional (that is, monomeric) UV absorbers can also be loaded into the UV absorbing polymer latexes of the photographic elements of the present invention to alter their photographic performance. Examples of such conventional UV absorbing agents which can be used include: 2-(2-hydroxy-5-methylphenyl)-2H-benzotriazole, 2-(2-hydroxy- 3,5-di-tert-butylphenyl)-2H-benzotriazole, 2-(2-hydroxy-3-tert-butyl-5-methylphenyl)-2H-benzotriazole, 2-(2-hydroxy-3,5-di-tert-butylphenyl)-5-chloro-2H-benzotriazole, 2-(2-hydroxy-3,5-di-tert-amylphenyl)-2H-benzotriazole, 2-(2-hydroxy-3,5-di(1,1-dimethylbenzyl)phenyl)-2H-benzotriazole, 2-(2-hydroxy-5-tert-octylphenyl)-2H-benzotriazole. Other types of UV absorbing agents include p-hydroxybenzoates, phenylesters of benzoic acid, salicylanilides and oxanilides, diketones, benzylidene malonate, esters of α-cyano-β-phenylcinnamic acid, and organic metal photostabilizers, and others, as described in J. F. Rabek, *Photostabilization of Polymers, Principles and Applications*, Elsevier Science Publishers LTD, England, page 202–278 (1990).

Polymeric UV absorbing materials derived from a monomer of formula (I) can be prepared by emulsion polymerization or solution polymerization. The preparation of preferred polymeric absorbing materials of this invention is set forth in detail below. The resulting polymers can either be a polymeric dispersion, or so-called latex, or a water-soluble polymer. Examples of the polymeric UV absorbers derived from formula (I) are listed below:

| Polymer I.D. | Compositiors | Molar Ratio | Polymer Forms |
|---|---|---|---|
| PUV-1 | UV-2:Butyl Acrylate:NaAMPS* | 1:1:0.1 | Latex |
| PUV-2 | UV-1:Butyl Acrylate:NaAMPS | 1:1:0.1 | Latex |
| PUV-3 | UV-2:Butyl Acrylate | 1:1 | Latex |
| PUV-4 | UV-2:Butyl Acrylate | 1:2 | Latex |
| PUV-5 | UV-2:Ethyl Acrylate:NaAMPS | 1:1:0.1 | Latex |
| PUV-6 | UV-2:2-Ethylhexyl Acrylate:NaAMPS | 1:1:0.1 | Latex |
| PUV-7 | UV-2:2-Ethoxyethyl Acrylate:NaAMPS | 1:1:0.1 | Latex |
| PUV-8 | UV-2:Butyl Acrylate:Acrylic Acid | 1:1:0.2 | Latex |
| PUV-9 | UV-2:Ethyl Acrylate:Acrylic Acid | 1:1:0.2 | Latex |
| PUV-10 | UV-2:Butyl Acrylate:NaAMPS | 1:1:0.2 | Polymer Dispersion |
| PUV-11 | UV-2:Butyl Acrylate:SEM** | 1:1:0.1 | Latex |
| PUV-12 | UV-2:AMPS | 1:0.1 | Latex |
| PUV-13 | UV-2:Butyl Acrylate:SSS*** | 1:1:0.1 | Latex |
| PUV-14 | UV-3:Butyl Acrylate:NaAMPS | 1:1:0.1 | Latex |
| PUV-15 | UV-4:Butyl Acrylate:NaAMPS | 1:1:0.1 | Latex |
| PUV-16 | UV-5:Butyl Acrylate:NaAMPS | 1:1:0.1 | Latex |
| PUV-17 | UV-6:Butyl Acrylate:NaAMPS | 1:1:0.1 | Latex |
| PUV-18 | UV-7:Butyl Acrylate:NaAMPS | 1:1:0.1 | Latex |
| PUV-19 | UV-8:Butyl Acrylate:NaAMPS | 1:1:0.1 | Latex |
| PUV-20 | UV-9:Butyl Acrylate:NaAMPS | 1:1:0.1 | Latex |
| PUV-21 | UV-10:Butyl Acrylate:NaAMPS | 1:1:0.1 | Latex |
| PUV-22 | UV-11:Butyl Acrylate:NaAMPS | 1:1:0.1 | Latex |
| PUV-23 | UV-12:Butyl Acrylate:NaAMPS | 1:1:0.1 | Latex |
| PUV-24 | UV-2:Butyl Acrylate:NaAMPS | 1:1:1 | Water-soluble polymer |
| PUV-25 | UV-2:Acrylamide:NaAMPS | 1:4.3:0.3 | Water-soluble Polymer |
| PUV-26 | UV-2:Acrylic Acid:NaAMPS | 1:4.2:0.3 | Water-soluble Polymer |
| PUV-27 | UV-2:Acrylamide:SSS | 1:4.3:0.3 | Water-soluble Polymer |

*NaAMPS = sodium acrylamido-2-methyl-2-propanesulfonic acid.
**SEM = Sodium sulfoethyl methacrylate.
***SSS = Sodium styrene sulfonate.

Monomer Synthesis:

The synthesis of UV-2 is given below as typical procedure of preparing UV monomers of this invention.

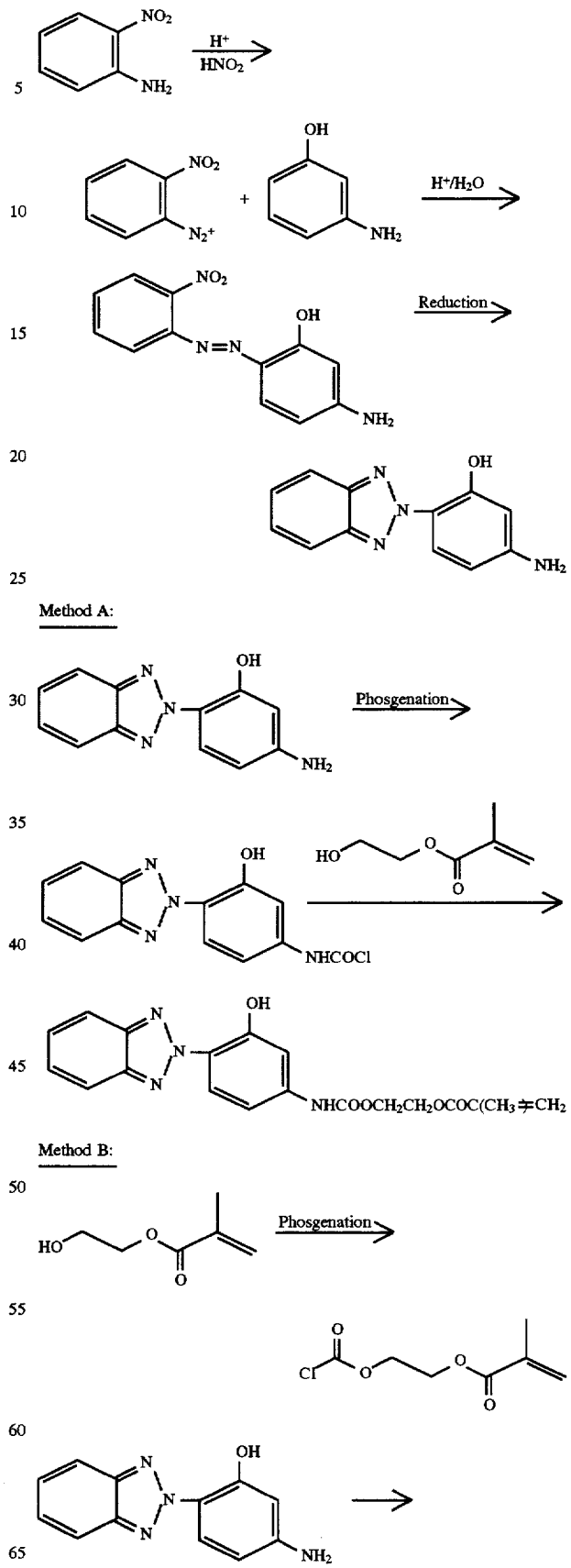

-continued

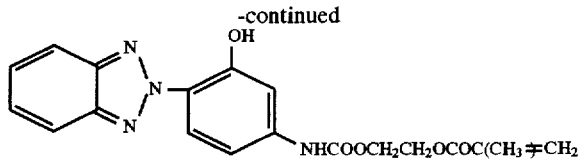

Procedure (Method A):

2-(2-hydroxy-4-aminophenyl)benzotriazole (33.9 g, 0.15 mole) was dissolved in 500 mL of dry tetrahydrofuran and magnetically stirred at room temperature under argon atmosphere. A 19.1% solution of phosgene in toluene (15 g, 79 mL, 0.155 mole) was added dropwise through a dropping funnel. An instantaneous reaction with evolution of hydrogen chloride fumes occurred but it was not exothermic. After 20 minutes, triethylamine (15 g, 21 mL, 0.155 mole) was added dropwise. A copious white precipitate of triethylammonium hydrochloride initially formed which dissolved after about 30 minutes. 2-Hydroxyethyl methacrylate (20.8 g, 0.155 mole) was taken in 50 mL tetrahydrofuran (THF) and added dropwise to the reaction mixture and was stirred for next 15 minutes. An additional triethylamine (15 g, 21 mL, 0.155 mole) was added slowly. Again a copious white precipitate formed which stayed in, but no exotherm was observed at any stage. After 4 hours, the solvent was removed on a rotary evaporator. The residue was triturated with cold water (300 mL). The solid material was filtered on a sintered glass funnel, washed with cold water (2×150 mL), air-dried, then dried in a vacuum oven at 60°–70° C. at a 25 mm Hg pressure. Yield was 55.0 g(95% crude). According to HPLC analysis of a crude sample, it contained 5% of unreacted triazole compound and about 10% of diacylated derivative. It was further purified by silica gel flash column chromatography eluting with a dichlormethane-methanol (100 mL–10 mL) mixture. A 15 g sample of pure monomer was obtained. Its TLC showed an Rf of 0.5 in heptane/ethyl acetate (6.5/3.5). It had important IR bands at 3342, 3107, 2954, 1736, 1701, 1631, 1602, 1537, 1345, 1220, 1180, 1055 and 738 $cm^{-1}$. Elemental analysis for $C_{19}H_{18}N_4O_5$ (M.W. 382.4): Calculated. C, 59.68; H, 4.74; N, 14.65. Found: C, 59.94; H, 4.95; N, 14.69. It had NMR peaks in ($CDCl_3$) at δ 11.40 (s, 1H, phenolic OH), 8.3 (d, 1H, arom.), 7.9 (m, 2H, arom), 7.45 (m, 2H, arom), 7.3 (s, 1H), 7.1 (d, 1H, arom.), 6.97 (s, 1H), 6.18 (s, 1H, vinylic), 5.62 (s, 1H, vinylic), 4.43 (2 triplets merged with each other, 4H, 2x $CH_2$), and 1.98 (s, 3H, $CH_3$). Its UV-VIS (MeOH) showed a $\lambda_{max}$ 343 nm and an $\epsilon_{max}$ $2.64\times10^4$.

Procedure (Method B):

This method is the preferred mode of making the pure monomer under an essentially neutral reaction condition following a procedure to condense m-amino phenol with methoxycarbonyl chloride giving exclusively the desired carbamate without any acylation at phenolic group. Thus, an 11.2-g (0.058 mole) sample of methacryloyloxyethoxycarbonyl chloride was added dropwise during 30 minutes with mechanical stirring and cooling (10°–15° C.) to a suspension of 11.3 g (0.05 mole) of 2-(2-hydroxy-4-amino phenyl) benzotriazole and 6.25 g (0.063 mole) of $KHCO_3$ in SSS= Sodium styrene sulfonate 150 mL of ethyl acetate and 10 mL of water, after which the mixture was stirred for another 3 hours in presence of 50 mg of 2,6-di-t-butyl-4-methyl phenol(as an inhibitor). The aqueous layer was separated, and the organic layer was washed successively with water (100 mL), 1M sulfuric acid (20 mL), water (100 mL), brine (100 mL), dried ($Na_2SO_4$), filtered, solvent was removed on rotary evaporator. The off-white solid residue was triturated with isopropanol-pentane (30/70). SSS=Sodium styrene sulfonate. Filtered, washed with pentane and air-dried. Yield, 17.6 g (92%). TLC (Heptane/ethyl acetate, 6.5/3.5): one spot, Rf=0.5. It was about 99% pure by HPLC (peak area percent).

Polymer Synthesis:

Synthesis of PUV-1 is described below as typical example of emulsion polymerization of monomers defined as formula I.

Synthesis of PUV-1:

2160g of deionized water, 28.5 g of sodium N-methyl-N-oleoyltaurate (Igepon T-33), and 480 mL of N,N-dimethylformamide were mixed in a 12 L 4-neck round bottom flask equipped with a mechanical stirrer, nitrogen inlet, and condenser. The flask was immersed in a constant temperature bath at 80° C. and heated for 30 mins with nitrogen purging through. 1.712 g of sodium persulfate was added. 5 mins later, monomer solution comprising 122.4 g of UV-2, 41.04 g of butyl acrylate, and 1200 mL of N,N-dimethylformamide and co-feed solution comprising 14.24 g of Igepon T-33, 1.712 g of sodium persulfate, 12.72 g of sodium AMPS (trade name of Lubrizol) and 2880 mL water were pumped into the reactor together over six hours. The polymerization was continued for overnight. The latex was cooled, filtered and diafiltered to 23.9% solid with Amicon's Ultrafiltration unit. The Z-average particle size measured by Malvern's Autosizer IIC was 93 nm. The elemental analysis confirmed the composition.

Synthesis of PUV-3:

180 g of deionized water, 1.27 g of sodium N-methyl-N-oleoyltaurate (Igepon T-33), and 20 g of acetone were mixed in a 0.5 L 4-neck round bottom flask equipped with a mechanical stirrer, nitrogen inlet, and condenser. The flask was immersed in a constant temperature bath at 80° C. and heated for 30 mins with nitrogen purging through. 3.06 g of 5% potassium persulfate was added. 5 mins later, monomer solution comprising 5.74 g of UV-2, 1.923 g of butyl acrylate, 75 ML of N,N-dimethylformamide and 15 ML of acetone was fed into reactor over four hours. One hour after the monomer feed started, a cofeed solution comprising 0.63 g of Igepon T-33, 1.53 g of 5% potassium persulfate, and 20 mL water was pumped into the reactor together over three hours. The polymerization was continued for overnight. The latex was cooled, filtered, dialyzed, and concentrated to 5.31% solid with Amicon's Ultrafiltration unit. The Z-average particle size measured by Malvern's Autosizer IIC was 76 nm. The elemental analysis confirmed the composition.

Synthesis of PUV-4:

180 g of deionized water, 1.6 g of sodium N-methyl-N-oleoyltaurate (Igepon T-33), and 20 g of acetone were mixed in a 0.5 L 4-neck round bottom flask equipped with a mechanical stirrer, nitrogen inlet, and condenser. The flask was immersed in a constant temperature bath at 80° C. and heated for 30 mins with nitrogen purging through. 3.83 g of 5% potassium persulfate was added. 5 mins later, monomer solution comprising 5.74 g of UV-2, 3.845 g of butyl acrylate, 75 ML of N,N-dimethylformamide and 15 ML of acetone was fed into reactor over four hours. One hour after the monomer feed started, a cofeed solution comprising 0.8 g of Igepon T-33, 1.92 g of 5% potassium persulfate, and 20 mL water was pumped into the reactor together over three hours. The polymerization was continued for overnight. The latex was cooled, filtered, dialyzed, and concentrated to 6.94% solid with Amicon's Ultrafiltration unit. The Z-average particle size measured by Malvern's Autosizer IIC was 177 nm. The elemental analysis confirmed the composition.

A dispersion of a polymer of the present invention is incorporated into the photographic element (typically into a gelatin gel thereof) in an amount of between 0.2 g/m$^2$ to 10 g/m$^2$, and more preferably between 0.5 g/m$^2$ to 5.0 g/m$^2$. Furthermore, the weight ratio of high boiling, water immiscible organic solvent, when present, to polymer latex is preferably between 0.1 to 5.0 (that is, 0.1/1 to 5.0/1 of solvent/polymer latex), and more preferably between 0.2 to 3.0 (that is, 0.2/1 to 3.0/1 of solvent/polymer latex).

As to the construction of a photographic element of the present invention, the element has at least one light sensitive layer which is preferably a silver halide emulsion layer. The element additionally preferably has a non-light sensitive layer, with the ultraviolet absorbing polymer being located in the non-light sensitive layer. The non-light sensitive layer containing the ultraviolet absorbing polymer is preferably located above all light sensitive layers.

The polymer latexes are preferably prepared by emulsion polymerization. Emulsion polymerization is well known in the art and is described, for example, in F. A. Bovey, *Emulsion Polymerization*, issued by Interscience Publishers Inc. New York, 1955. Examples of the chemical initiators which may be used include a thermally decomposable initiator, for example, a persulfate (such as ammonium persulfate, potassium persulfate, etc), hydrogen peroxide, 4,4'-azobis(4-cyanovaleric acid), and redox initiators such as hydrogen peroxide-iron(II) salt, potassium persulfate-sodium hydrogensulfate, cerium salt-alcohol, etc. Emulsifiers which may be used in the emulsion polymerization include soap, a sulfonate(for example, sodium N-methyl-N-oleoyltaurate, etc.), a sulfate (for example, sodium dodecyl sulfate, etc.), a cationic compound (for example, hexadecyl trimethylammonium bromide, etc.), an amphoteric compound and a high molecular weight protective colloid(for example, polyvinyl alcohol, polyacrylic acid, gelatin, etc.). Specific examples and functions of the emulsifiers are described in *Belgische Chemische Industrie*, Vol.28, pages 16–20 (1963).

Emulsion polymerization of solid water-insoluble UV absorbing monomer is usually carried out in an aqueous system or a water/organic solvent system. Organic solvents which can be used are preferably those which have high water miscibility, are substantially inert to the monomers to be used, and do not interrupt usual reactions in free radical addition polymerization. Preferred examples include a lower alcohol having from 1 to 4 carbon atoms (for example, methanol, ethanol, isopropanol, etc.), a ketone (for example, acetone, etc.), a cyclic ether (for example, tetrahydrofuran, etc.), a nitrile (for example, acetonitrile,etc.), an amide (for example, N,N-dimethylforamide, etc.), a sulfoxide (for example, dimethylsulfoxide), and the like. This method is the most direct way of preparing a polymer latex as described in U.S. Pat. Nos. 4,464,462; 4,455,368 and European Patent publication 0 190 003 (1991).

High boiling organic solvents (so-called coupler solvent) can also be added to modify the physical properties of the photographic materials The loading of high boiling organic solvents into polymer latex was described in the following publications: U.S. Pat. No. 4,199,363, U.S. Pat. No. 4,203,716, U.S. Pat. No. 4,214,047, U.S. Pat. No. 4,247,627, U.S. Pat. No. 4,497,929, and U.S. Pat. No. 4,608,424.

As to the method of loading the high boiling point organic solvent in the polymer latex, "loading" a polymer latex is generally described in U.S. Pat. No. 4,199,363 for example. There are several methods of loading the high boiling point solvents into the polymer latex. First, an aqueous dispersion of a high boiling point solvent (or mixture of such solvents) is prepared by the conventional colloid mill process in the presence of gelatin. This dispersion is then blended with the polymer latex such that the weight ratio of high boiling, water immiscible organic solvent to polymer latex is between 0.1 to 5.0 (that is, 0.1/1 to 5.0/1 of solvent/polymer latex), and more preferably between 0.2 to 3.0 (that is, 0.2/1 to 3.0/1 of solvent/polymer latex).

In a second method of loading the polymer latex, the high boiling point solvent is loaded into the polymeric UV absorbing agent in the presence of low boiling organic solvents, such as methanol or acetone. The auxiliary solvent is then evaporated with a rotary evaporator. The same weight ratios of high boiling, water immiscible organic solvent can be used as in the above method.

Loading of a polymer latex is also described, for example, in U.S. Pat. No. 4,203,716, U.S. Pat. No. 4,214,047, U.S. Pat. No. 4,247,627, U.S. Pat. No. 4,497,929 and U.S. Pat. No. 4,608,424.

A dispersion of a polymer of the present invention is incorporated into the photographic element (typically into a gelatin gel thereof) in an amount of between 0.2 g/m$^2$ to 10 g/m$^2$, and more preferably between 0.5 g/m$^2$ to 5.0 g/m$^2$. Furthermore, the weight ratio of high boiling, water immiscible organic solvent, when present, to polymer latex is preferably between 0.1 to 5.0 (that is, 0.1/1 to 5.0/1 of solvent/polymer latex), and more preferably between 0.2 to 3.0 (that is, 0.2/1 to 3.0/1 of solvent/polymer latex).

The polymer of the present invention is provided in any one or more of the layers (for example, a hydrophilic colloid layer) of a photographic light-sensitive material (preferably a silver halide photographic light-sensitive material), such as a surface protective layer, an intermediate layer or a silver halide emulsion layer, and the like. For example, in photographic paper the UV absorbing polymer latex may be positioned above and/or below the red sensitive layer (preferably above and adjacent to it), the red sensitive layer typically being the uppermost light sensitive layer in color paper, or even completely or partially within the red sensitive layer.

The photographic elements made by the method of the present invention can be single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support).

Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to *Research Disclosure*, September 1994, Number 365, Item 36544, which will be identified hereafter by the term "Research Disclosure I." The Sections hereafter referred to are Sections of the Research Disclosure I unless otherwise indicated. All Research Disclosures referenced are published by Kenneth Mason Publications, Ltd., Dudley Annex, 12a North Street, Emsworth, Hampshire P010 7DQ, ENGLAND. The foreoging references and all other references cited in this application, are incorporated herein by reference.

The silver halide emulsions employed in the photographic elements of the present invention may be negative-working, such as surface-sensitive emulsions or unfogged internal latent image forming emulsions, or positive working emulsions of internal latent image forming emulsions (that are either fogged in the element or fogged during processing). Suitable emulsions and their preparation as well as methods of chemical and spectral sensitization are described in Sections I through V of *Research Disclosure I*. Color materials and development modifiers are described in Sections V through XX. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in in Section XI, exposure alternatives in Section XVI, and processing methods and agents in Sections XIX and XX.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as "Developer Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540,653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds useful in the elements of the invention are disclosed in Japanese Published Applications 83-09,959; 83-62,586; 90-072,629, 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90-080,491; 90-080,492; 90-080,494;

90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide used in the photographic elements may be silver iodobromide, silver bromide, silver chloride, silver chlorobromide, silver chloroiodobromide, and the like. For example, the silver halide used in the photographic elements of the present invention may contain at least 90% silver chloride or more (for example, at least 95%, 98%, 99% or 100% silver chloride). In the case of such high chloride silver halide emulsions, some silver bromide may be present but typically substantially no silver iodide. Substantially no silver iodide means the iodide concentration would be no more than 1%, and preferably less than 0.5 or 0.1%. In particular, in such a case the possibility is also contemplated that the silver chloride could be treated with a bromide source to increase its sensitivity, although the bulk concentration of bromide in the resulting emulsion will typically be no more than about 2 to 2.5% and preferably between about 0.6 to 1.2% (the remainder being silver chloride). The foregoing % figures are mole %.

The type of silver halide grains preferably include polymorphic, cubic, and octahedral. The grain size of the silver halide may have any distribution known to be useful in photographic compositions, and may be either polydispersed or monodispersed.

Tabular grain silver halide emulsions may also be used. Tabular grains are those with two parallel major faces each clearly larger than any remaining grain face and tabular grain emulsions are those in which the tabular grains account for at least 30 percent, more typically at least 50 percent, preferably >70 percent and optimally >90 percent of total grain projected area. The tabular grains can account for substantially all (>97 percent) of total grain projected area. The tabular grain emulsions can be high aspect ratio tabular grain emulsions—i.e., ECD/t>8, where ECD is the diameter of a circle having an area equal to grain projected area and t is tabular grain thickness; intermediate aspect ratio tabular grain emulsions—i.e., ECD/t=5 to 8; or low aspect ratio tabular grain emulsions—i.e., ECD/t=2 to 5. The emulsions typically exhibit high tabularity (T), where T (i.e., $ECD/t^2$) >25 and ECD and t are both measured in micrometers (μm). The tabular grains can be of any thickness compatible with achieving an aim average aspect ratio and/or average tabularity of the tabular grain emulsion. Preferably the tabular grains satisfying projected area requirements are those having thicknesses of <0.3 μm, thin (<0.2 μm) tabular grains being specifically preferred and ultrathin (<0.07 μm) tabular grains being contemplated for maximum tabular grain performance enhancements. When the native blue absorption of iodohalide tabular grains is relied upon for blue speed, thicker tabular grains, typically up to 0.5 μm in thickness, are contemplated.

High iodide tabular grain emulsions are illustrated by House U.S. Pat. No. 4,490,458, Maskasky U.S. Pat. No. 4,459,353 and Yagi et al EPO 0 410 410.

Tabular grains formed of silver halide(s) that form a face centered cubic (rock salt type) crystal lattice structure can have either {100} or {111} major faces. Emulsions containing {111} major face tabular grains, including those with controlled grain dispersities, halide distributions, twin plane spacing, edge structures and grain dislocations as well as adsorbed {111} grain face stabilizers, are illustrated in those references cited in *Research Disclosure I*, Section I.B.(3).

The silver halide grains to be used in the invention may be prepared according to methods known in the art, such as those described in *Research Disclosure I* and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions.

These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30° C. to 80° C., as described in *Research Disclosure I*, Section IV and the references cited therein.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alocohol. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I*, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I*, or in T. H. James, editor, *The Theory of the Photographic Process*, 4th Edition, Macmillan, New York, 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer.

Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethylaniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is followed by bleach-fixing, to remove silver or silver halide, washing and drying.

Comparison polymeric UV absorbers were prepared by a method similar to that described above. Their structures of comparison polymers CP-1 to CP-6 are shown below:

| Polymer I.D. | Structure | References |
|---|---|---|
| Comparison Polymer CP-1 | 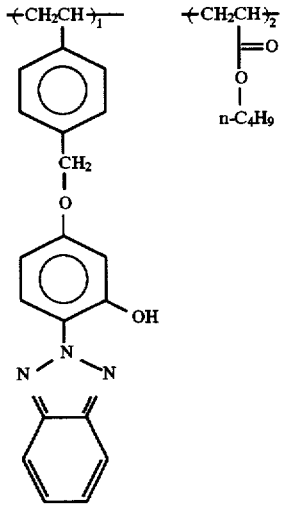 | EP 190 003 |
| Comparison Polymer CP-2 | 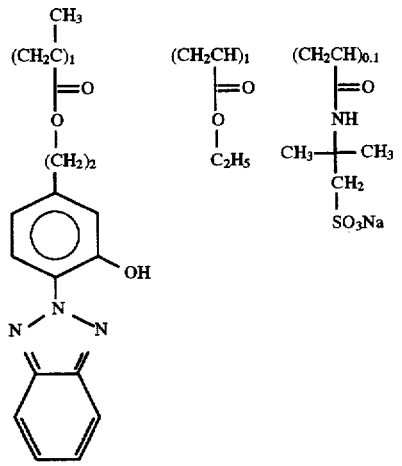 | U.S. Pat. No. 5,384,235 |

-continued
| Polymer I.D. | Structure | References |
|---|---|---|
| Comparison Polymer CP-3 | 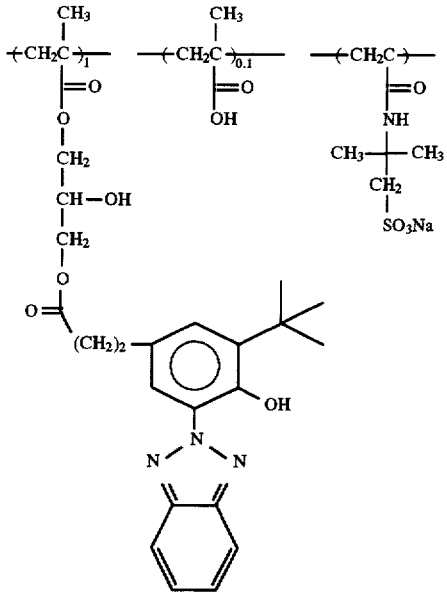 | Research Disclosure 32592 (1991) |
| Comparison Polymer CP-4 | 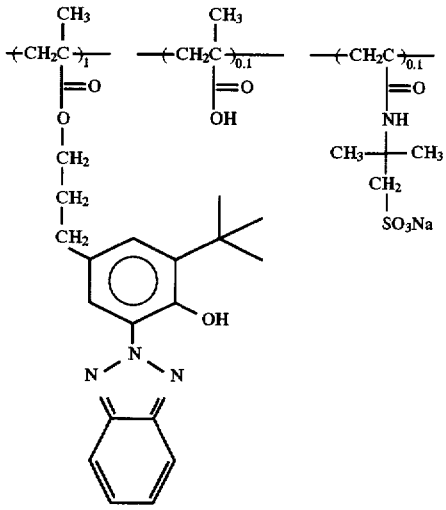 | U.S. Pat. No. 5,384,235 |

-continued

| Polymer I.D. | Structure | References |
|---|---|---|
| Comparison Polymer CP-5 | 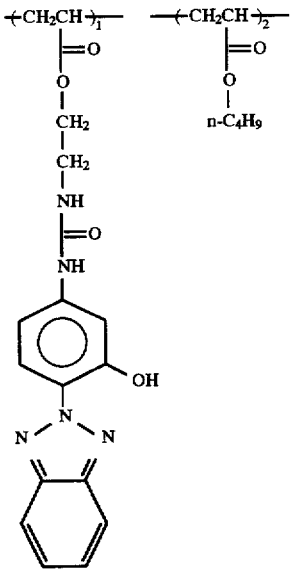 | U.S. Pat. No. 4,943,519 |
| Comparison Polymer CP-6 | 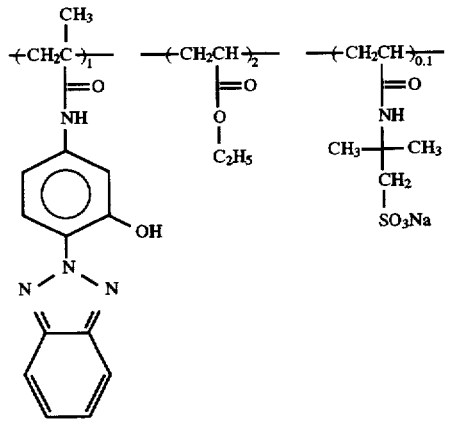 | U.S. Pat. No. 3,761,272 |

CP-5 and CP-6 are structurally similar to the UV absorbing polymers of this the invention except that the linkage group at the 4 position is urea and amide in CP-5 and CP-6, respectively. The effect of the linkage group on the absorption curves and on the photographic performances will be demonstrated on the tests below. A non-polymeric, conventional UV absorber, designated as CUV-1, was also prepared as cross check. This is composed of Tinuvin 328 (0.85), Tinuvin 326 (0.15)(trade name of Ciba-Geigy), 1,4-cyclohexylenedimethylene bis(2-ethylhexamoate)(0.33), 2,5-bis(1,1,3,3-tetramethylbutyl)-1,4-benzenediol(0.114), 10% Alkanol LC, from Du Pont, (0.555), and Gel(0.708). The numbers inside the parentheses are the relative weight ratios of the components. The dispersion was prepared by the colloid mill process in the presence of gelatin as known in the art. Average particle size is 273 nm.

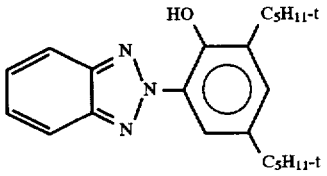

Tinuvin 328

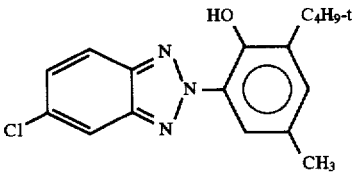

Tinuvin 326

Photographic Evaluation:

1. Absorption Spectrum

The absorption spectrum of polymeric UV absorbers used in the photographic materials is the most important criteria. The extinction coefficient between 340 nm and 400 nm is most critical for the protection of the photographic paper against light-induced yellowing and image dye fade. The absorption in this range should be as high as possible, but the absorption beyond 400 nm should be as low as possible. The absorption above 400 nm makes the photographic paper appear yellowish and is not desirable. The whiteness of the photographic paper is represented by so-called fresh Dmin and is the blue density of processed photographic paper on the unexposed area. To measure the absorption curves of polymeric ultraviolet absorbing material of this invention, and comparison UV absorbing materials, samples were coated on the clear support with the same molar laydown. The coating format is as follows:

| | |
|---|---|
| Overcoat | 1345.5 mg/m$^2$ gel |
| | 11.3 mg/m$^2$ Alkanol XC* |
| | 4.24 mg/m$^2$ FT-248** |
| | 53.3 mg/m$^2$ BVSME*** |
| UV Layer | 150 mg gel (1614.6 mg/m$^2$) |
| | 43.06 mg/m$^2$ Alkanol-XC |
| | 2.15 mmole/m$^2$ UVA |
| ////Cellulose Triacetate Film Support/// | |

Figure 2:
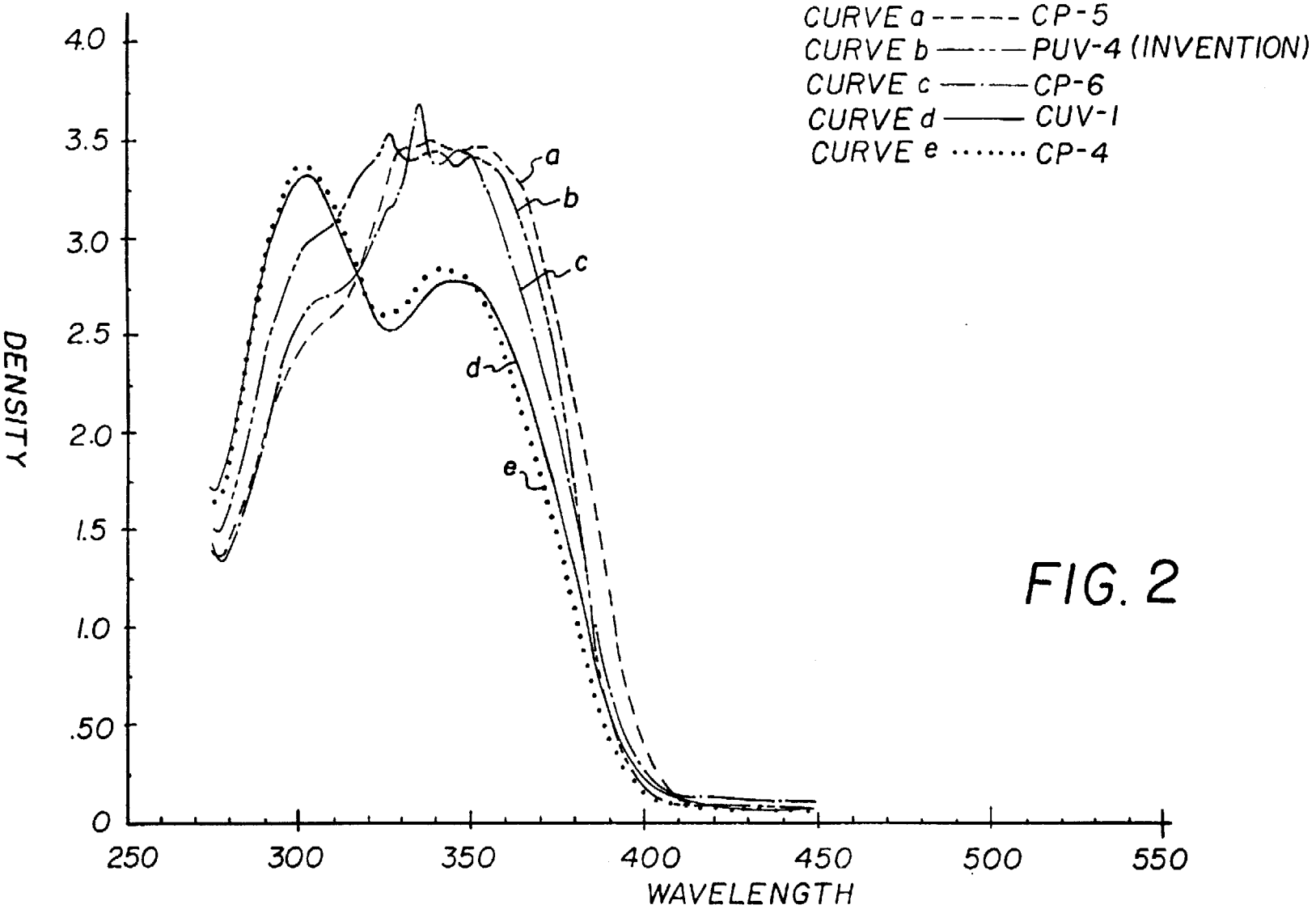

*Alkanol XC is a surfactant commercially available from Du Pont
**FT-248 isa surfactant commercially available from Du Pont
***BVSME is bisvinyl sulfone methyl ether The absorption spectra of the polymeric UV absorbers and CUV-1 were measured with HP-1000 UV-Visible spectroscopy and the results are shown in FIG. 1 and FIG. 2. It is clear that PUV-4, CP-1 ,CP-5, and CP-6 have the highest extinction coefficient between 340 nm and 400 nm. But the absorption curve of CP-1 is too hypsochromic and the absorption curves of CP-5 and CP-6 are too bathochromic. CP-5 and CP-6 have similar UV chromophores to that of PUV-4 except with different linkage groups. These different linkage groups have unexpected effects on the absorption spectrum, on the intrinsic light stability, and on the protection of photographic materials. To compare the intrinsic light stabilities of PUV-4, CP-5, and CP-6, the coatings described above were subjected to 4 weeks fadeometer exposure. Samples were irradiated at a distance such that the irradiance on the sample was 50 Klux (or so-called HIS test). The absorbance of these three polymeric UV absorbers at 360 nm before and after the 4 weeks HIS testing are taken and the decrease in the absorbance at 360 nm was calculated.

TABLE 1

| Polymer | Initial Spectral Density @ 360 mn | 4 weeks HIS Spectral Density @ 360 nm | % Optical Density Loss @ 360 |
|---|---|---|---|
| PUV-4 | 3.305 | 3.163 | 4.3% |
| CP-5 | 3.41 | 2.192 | 35.7% |
| CP-6 | 3.04 | 2.75 | 9.7% |

The results shows that PUV-4 has much better intrinsic light stability than that of the two closest comparison polymers.

The effects of the absorption characteristics of various polymeric UV absorbers on the performance of the photographic papers are shown in the following test.

2. Fresh Dmin, Dye Fade and Light-Induced Yellowing:

Photographic elements in the form of color photographic paper were prepared with the layer arrangement shown below. Experiments were conducted on the Fresh Dmin, the light-induced yellow stain and the image dye stability against light. The coating format for the evaluation of these properties is shown below.

| Layer No. | Layer Name | mg/m$^2$ unless otherwise indicated | |
|---|---|---|---|
| 8 | Protective Layer | 1345.5 | Gelatin |
| | | 11.3 | Alkanol-XC |
| | | 4.24 | FT-248 |
| | | 1.8% | BVSME (based on total weight of gelatin) |
| 7 | UV Layer | 1614.6 | Gelatin |
| | | 43.06 | Alkanol-XC |
| | | 0.2 mmole | UV absorber mmole/m$^2$?? (unless specified) |
| 6 | Interlayer | 21.5 | Scavanger 1 |
| | | 1076.4 | Gelatin |
| 5 | Cyan layer | 1076.4 | Gelatin |
| | | 423.0 | Cyan Coupler |
| | | 5.81 | Scavenger |
| | | 179.8 | Red Sensitized AgCl Emulsion |
| | | 230.8 | Coupler Solvent |
| 4 | Interlayer | 699.7 | Gelatin |
| | | 43.27 | Scavenger 1 |
| 3 | Magenta layer | 1237.9 | Gelatin |
| | | 389.0 | Magenta Coupler |
| | | 206.7 | Magenta Stabilizer |
| | | 286.9 | Green Sensitized AgCl Emulsion |
| | | 153.4 | Coupler Solvent |
| 2 | Interlayer | 753.48 | Gelatin |
| | | 94.2 | Scavenger 1 |
| 1 | Yellow layer | 1507.0 | Gelatin |
| | | 732.27 | Yellow Coupler |
| | | 254.4 | Blue Sensitized AgCl Emulsion |
| | | 9.47 | Scavenger 2 |
| Support | Sublayer 1 | Resin Coat: Titanox and Optional Brightner Dispersed in Polyethylene | |
| | Sublayer 2 | Paper | |
| | Sublayer 3 | Resin Coat: | Polyethylene |

All image couplers, scavengers and image stabilizers are co-dispersed in dibutyl phthalate by the conventional milled process. The structures of the foregoing are as follows:

Magenta coupler
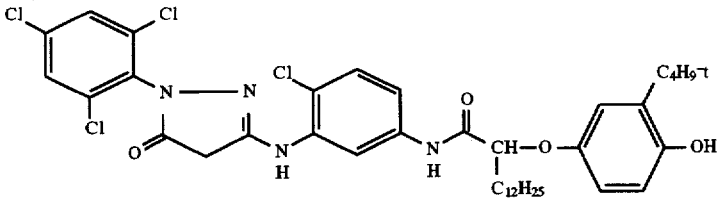
Yellow Coupler
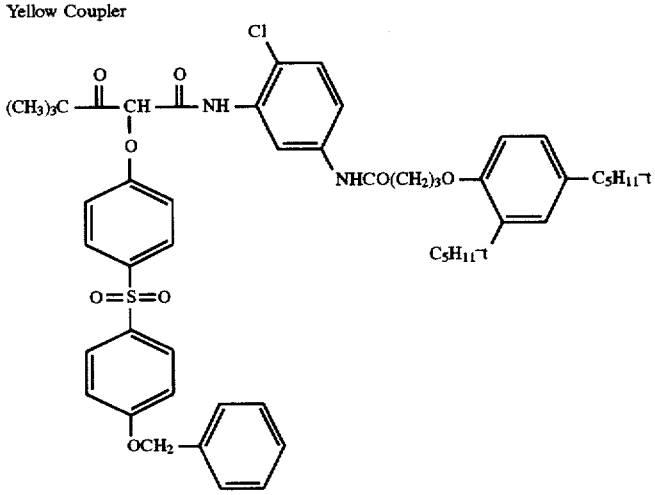
Cyan Coupler
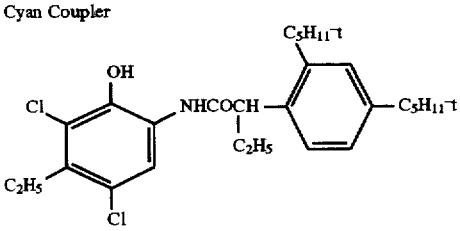
Scavenger 1
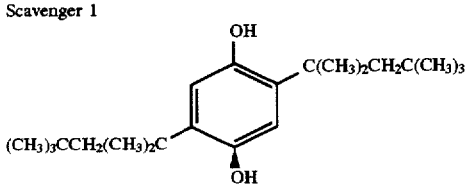
Scavenger 2
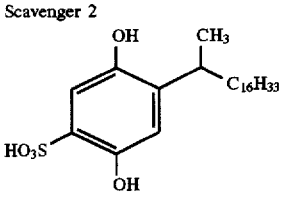
Stabilizer
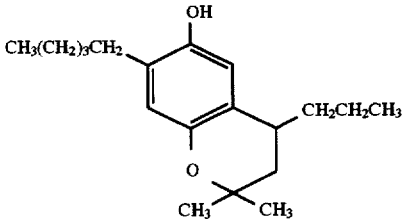

The photographic papers with the arrangement described above were processed by the well-known RA-4 process (see Research Disclosure I, Section XVIII (B)). Three important properties of the photographic papers were evaluated: (1) fresh blue Dmin,(2) light-induced blue Dmin increase (so-called yellowing), and (3) the image dye stability.

a. Measurements of Fresh Dmin and Light-Induced Yellowing:

Blue Dmin readings were measured by Spectrogard on fresh and incubated samples to study the blue density increase (yellowing) caused by light exposure. Fresh blue Dmin represents the whiteness of the color paper on the unexposed area prior to the incubation and the value should be as low as possible. The light-induced increase of blue Dmin, or so-called light-induced yellowing, of the photographic materials should also be as low as possible. The latter was carried out by the typical Xenon fadeometer exposure with Xe arc lamp as light source at 25° C. for two and four weeks. Samples were irradiated at a distance such that the irradiance on the sample was 50 Klux (or so-called HIS test).

TABLE 2

| UVA | Laydown (mmole/ $m^2$) | Fresh Blue Dmin | 2 week HIS Blue Dmin | 4 week HIS Blue Dmin | Remark |
|---|---|---|---|---|---|
| wk 278 | | | | | |
| PUV-4 | 2.15 | 0.129 | 0.093 | 0.149 | Invention |
| CUV-1 | 2,#5 | 0.122 | 0.105 | 0.184 | comparison |
| CP-1 | 2.15 | 0.123 | 0.097 | 0.193 | comparison |
| CP-2 | 2.15 | 0.12 | 0.101 | 0.200 | compaflson |
| CP-5 | 2.15 | 0.148 | 0.127 | 0.214 | comparison |
| wk 271 | | | | | |
| CUV-1 | 1.83 | 0.120 | 0.142 | 0.203 | comparison |
| CP-6 | 1.83 | 0.146 | 0.171 | 0.204 | comparison |

The results shows that PUV-4 because of its excellent absorption characteristics, has low fresh Dmin and has much lower light-induced yellowing than the comparison UV absorbers. Both of two closest check, i.e. CP-5 and CP-6, are bathochromic than that of PUV-4, have much higher fresh Dmin than the conventional cross check and are not acceptable for the use in photographic paper.

3. Image Dye Stability:

Photographic elements with the layer structure described above were exposed with step tablet wedge to three different colors (red, green, blue) on a sensitometer and subsequently processed by the RA-4 process to provide cyan, magenta, and yellow colors. The samples were subjected to a fading test with a Xenon lamp with filtered glass (50 Klux)(or so-called HID test) for 2 and 4 weeks. Dye density loss from the original density of 1.0 was measured and the data was used as the index for the image dye stability. Two separate sets of results are shown in the following table. Comparison polymers CP-5 and CP-6, are not evaluated because of their poor performances in fresh Dmin and light-induced yellowing.

TABLE 3

| | Laydown | 4 wks HID Image Dye Fade from density 1.0 | | | |
|---|---|---|---|---|---|
| UVA | (mmolc/$fm^2$) | Cyan | Magenta | Yellow | Remarks |
| wk 313 | | | | | |
| PUV-4 | 02.15 | −0.16 | −0.71 | −0.7 | Invention |
| CP-1 | 2.15 | −0.15 | −0.78 | −0.75 | comparison |

TABLE 3-continued

| | Laydown | 4 wks HID Image Dye Fade from density 1.0 | | | |
|---|---|---|---|---|---|
| UVA | (mmolc/$fm^2$) | Cyan | Magenta | Yellow | Remarks |
| CP-2 | 2.15 | −0.16 | −0.81 | −0.76 | comparison |
| CP-3 | 2.15 | −0.18 | −0.72 | −0.67 | comparison |
| wk 310 | | | | | |
| PUV-3 | 2.15 | −0.12 | −0.61 | −0.56 | Invention |
| CP-1 | 2.15 | −0.17 | −0.74 | −0.66 | Comparison |
| CP-2 | 2.15 | −0.14 | −0.77 | −0.69 | Comparison |
| CP-4 | 2.15 | −0.14 | −0.71 | −0.60 | Comparison |

From the table above, it is clear that the polymeric UV absorbers derived from UV-2 have better image dye protection than the comparison polymers.

The invention has been described in detail with particular reference to preferred embodiments, but it will be understood that variations and modifications can be effected within the spirit and scope of the invention.

What is claimed is:

1. A photographic element comprising at least one light sensitive silver halide emulsion layer and containing an ultraviolet absorbing polymer which includes units formed from monomers of the structure of formula (I):

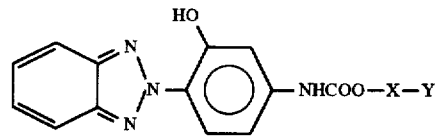

(I)

where X is a bivalent linking group having the formula:

$$-(((CH_2)_q-W)_r-(CH_2)_{q'})_s-$$

or $$-(CH_2)_t-Z-(CH_2)_u-$$

wherein W is oxygen or sulfur; Z is —NHCO—; $-CO_2-$; $-SO_2-$ and q and q' are independently 1–4, r is 0–4, s is 1–6, t is 1–6, and u is 1–6; and Y contains an ethylenically unsaturated functional group of the formula:

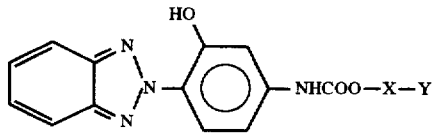

(I)

where $R_1$ is:

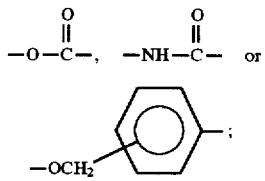

and $R_2$ is H or lower alkyl.

2. A photographic element comprising at least one light sensitive layer and containing an ultraviolet absorbing polymer which includes units formed from a monomer selected from the group consisting of:

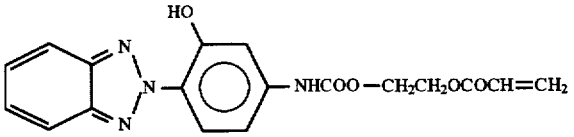

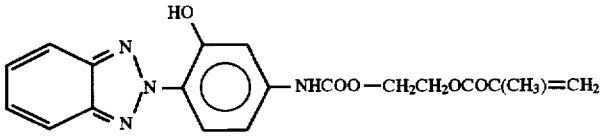

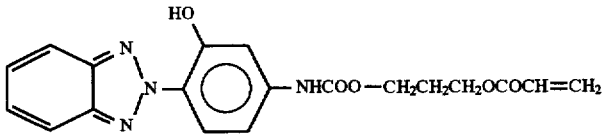

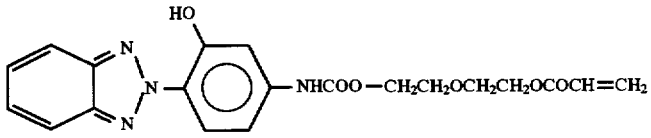

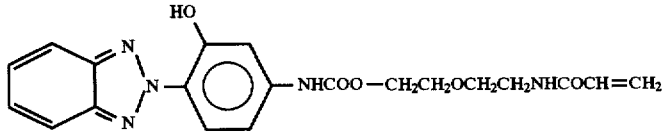

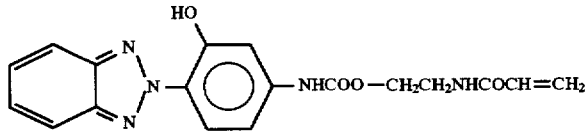

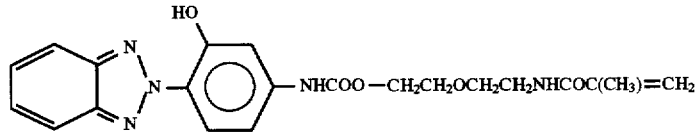

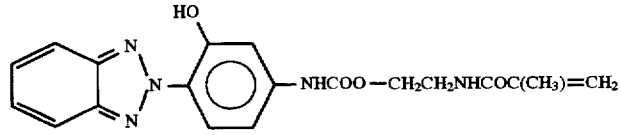

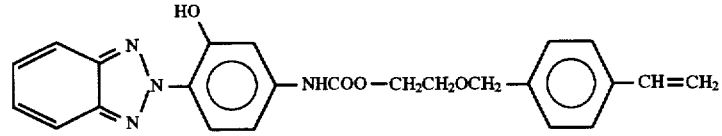

and

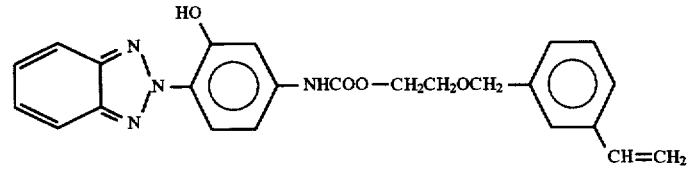

3. A photographic element according to claim 1 or claim 2, wherein the polymer is a homopolymer.

4. A photographic element according to claim 1 or claim 2, wherein the polymer is a copolymer of a monomer of the structure of formula (I) and at least one comonomer selected from the group consisting of: acrylic acid, α-alkylacryl acids, esters or amides derived from an acrylic acid or methacrylic acid, vinyl esters, acrylonitrile, methacrylonitrile, aromatic vinyl compounds, itaconic acid, citraconic acid, crotonic acid, vinylidene chloride, vinyl alkyl ethers, esters of maleic acid, N-vinyl-2-pyrrolidone, N-vinyl pyridine, 2- or 4-vinylpyridine, and sulfonic acid containing monomers.

5. A photographic element according to claim 4, wherein the copolymer comprises units formed from a compound of structural formula (I), and units formed from an ester of acrylic acid, an ester of methacrylic acid, or an aromatic vinyl compound.

6. A photographic element according to claim 4, wherein the copolymer comprises units formed from a compound of structural formula (I), and units formed from butyl acrylate, ethyl acrylate, ethoxyethyl acrylate, acrylamide, or acrylic acid.

7. A photographic element according to claim 6, wherein the copolymer further comprises units formed from sodium acrylamido-2-methyl-2-propanesulfonic acid, sodium sulfoethyl methacrylate, or sodium styrene sulfonate.

8. A photographic element according to claim 1 or claim 2, which further comprises a non-polymeric ultraviolet absorbing compound.

9. A photographic element according to claim 8, wherein said non-polymeric ultraviolet absorbing compound is selected from the group consisting of 2-hydroxyphenyl benzotriazole, 2-hydroxybenzophenone, salicylanilide oxanilides, benzylidene malonate, esters of α-cyano-β-phenylcinnamic acid, and phenyl esters of benzoic acid.

10. A photographic element according to claim 1 or claim 2, wherein the ultraviolet absorbing polymer is in the form of a latex.

11. A photographic element according to claim 1 or claim 2, which further comprises at least one non-light sensitive layer.

12. A photographic element according to claim 11, wherein the ultraviolet absorbing polymer is in the non-light sensitive layer.

13. A photographic element according to claim 12, wherein the non-light sensitive layer containing the ultraviolet absorbing polymer is above all light sensitive layers.

* * * * *